US005758590A

United States Patent [19]

Collier et al.

[11] Patent Number: 5,758,590

[45] Date of Patent: Jun. 2, 1998

[54] STACKING DEVICE FOR SHEET MATERIAL

[76] Inventors: Horace I. Collier; Robin C. Collier, both of P.O. Box 712, Haleyville, Ala. 35565; Randall W. Collier, P.O. Box 806, Killen, Ala. 35645

[21] Appl. No.: 604,865

[22] Filed: Feb. 22, 1996

[51] Int. Cl.[6] ..... D05B 33/00

[52] U.S. Cl. ..... 112/470.36

[58] Field of Search ..... 112/470.36, 121.29; 271/84, 85, 175

[56] References Cited

U.S. PATENT DOCUMENTS

| | | | |
|---|---|---|---|
| 3,126,848 | 3/1964 | Gastonguay | 112/470.36 X |
| 3,246,616 | 4/1966 | Korioth, III | 112/470.36 |
| 3,383,107 | 5/1968 | Hedegaard | 271/68 |
| 3,701,328 | 10/1972 | Frost . | |
| 3,906,878 | 9/1975 | Burton | 112/470.36 X |
| 3,951,400 | 4/1976 | Blessing et al. | 271/85 |
| 4,102,284 | 7/1978 | Rohr . | |
| 4,624,615 | 11/1986 | Russell et al. | 112/470.36 X |
| 4,848,763 | 7/1989 | Weir | 271/85 |
| 5,018,463 | 5/1991 | Nakajima . | |
| 5,109,781 | 5/1992 | Sasamoto | 112/470.36 X |
| 5,456,192 | 10/1995 | Trigg et al. | 112/470.36 X |

FOREIGN PATENT DOCUMENTS

| | | |
|---|---|---|
| 3-60695 | 3/1991 | Japan . |
| 4-26487 | 1/1992 | Japan . |

*Primary Examiner*—Paul C. Lewis
*Attorney, Agent, or Firm*—Kennedy, Davis & Kennedy

[57] ABSTRACT

A stacker (10) for stacking sheets of material (17) is provided which is mounted to the sewing bed (12) of a sewing machine (11). The stacker has a support bed (26), a wheel assembly (29), and a grasping assembly (30). The wheel assembly advances the material over a rearward edge of the support bed to a position wherein a leading portion (19) of the material depends therefrom while a trailing portion (22) is held thereto by a movably motorized wheel (34) and holding finger (37). The grasping assembly includes a pair of reciprocating grasping fingers (46) mounted to a pivotably arm (43). In stacking the material, the grasping fingers grasp the trailing portion of the material while the arm pivots the trailing portion over the leading portion to a stacking position S.

22 Claims, 3 Drawing Sheets

STACKING DEVICE FOR SHEET MATERIAL

TECHNICAL FIELD

The present invention relates to stackers used to stack sheets of material, and especially to stackers used to stack sheets of material which are used in conjunction with sewing machines.

BACKGROUND OF THE INVENTION

Stackers have been used for many years to sequentially stack material. These stackers are oftentimes used in conjunction with sewing machines for the stacking of material once it has completed a prior stitching operation.

With the advent of high speed sewing machines problems have arisen with regard to these stackers. Foremost is the fact that the operating rate of the sewing machine has increased far beyond the operating rate of the stacker. Hence, the stacker is not capable of stacking the material at the same speed at which it is sewn. Consequently, the sewing machine is oftentimes operated at a slower speed than its optimal speed. This is obviously an inefficient use of a high speed sewing machine.

Attempts have been made in the past to design a high speed stacker. For example, U.S. Pat. No. 4,102,284 shows a stacker which grips the material at one position adjacent the sewing machine and moves it to another stacked position. However, the material must travel a distance approximately twice as long as the material itself. This extended distance of travel severely hampers the speed of the stacker. Similarly, the stackers of U.S. Pat. Nos. 3,701,328 and 5,018,463 require the movement of the material over distances greater than the length of the material.

Other types of devices have also been designed for stacking material. However, these stackers employ the use of several moving components to accomplish the task. For example, the stacker shown in U.S. Pat. No. 4,848,763 requires the use of two conveyor belts and a pivotal arm. The movement of the material along each of these three components requires time, a requirement which obviously defeats efficiency.

Thus, there exists a need for an improved device for the efficient stacking of material. Accordingly, it is to the provision of such that the present invention is primarily directed.

SUMMARY OF THE INVENTION

In a preferred form of the invention, a stacking device for use with a sewing machine having a sewing head for stitching a sheet of material having a leading portion adjacent a leading edge and a trailing portion adjacent a trailing edge each with respect to the direction of movement as the material is stitched by the sewing machine, comprises support means for supporting a trailing portion of a sheet of material thereon with a leading portion of the material to depend therefrom. The stacking device also has holding means for releasably holding the trailing portion of the material with the leading portion depending from the support means, grasping means for grasping the material adjacent the material trailing edge, pivot means for reciprocally moving the grasping means between a grasping position adjacent the support means and a stacking position distal the support means, and control means for controlling the actuation of the holding means, the grasping means and the pivot means. With this construction, upon completion of the stitching of the material the material is positioned with the material leading portion depending from the support means and the holding means holding the material trailing portion, the grasping means is actuated to grasp the material trailing portion, and the pivot means moves the grasping means to the stacking position whereupon the grasping means are actuated to release the material.

In another preferred form of the invention a method is provided for stacking a sheet of material having a top surface, a bottom surface, and a leading portion and a trailing portion with respect to the orientation and direction of material movement as it is sewn. The method comprises the steps of advancing the material with the top surface facing upwards over the upper surface of a support surface to a position wherein the material leading portion extends beyond an edge of the support surface so as to gravitationally depend therefrom, holding the material trailing portion, grasping the material trailing portion with grasping means, moving the grasping means so as to move the trailing portion along an arc generally above the material leading portion depending from the support surface so as to invert the material with the bottom surface facing upwards, and releasing the material trailing portion.

DETAILED DESCRIPTION OF THE INVENTION

Figure 1:
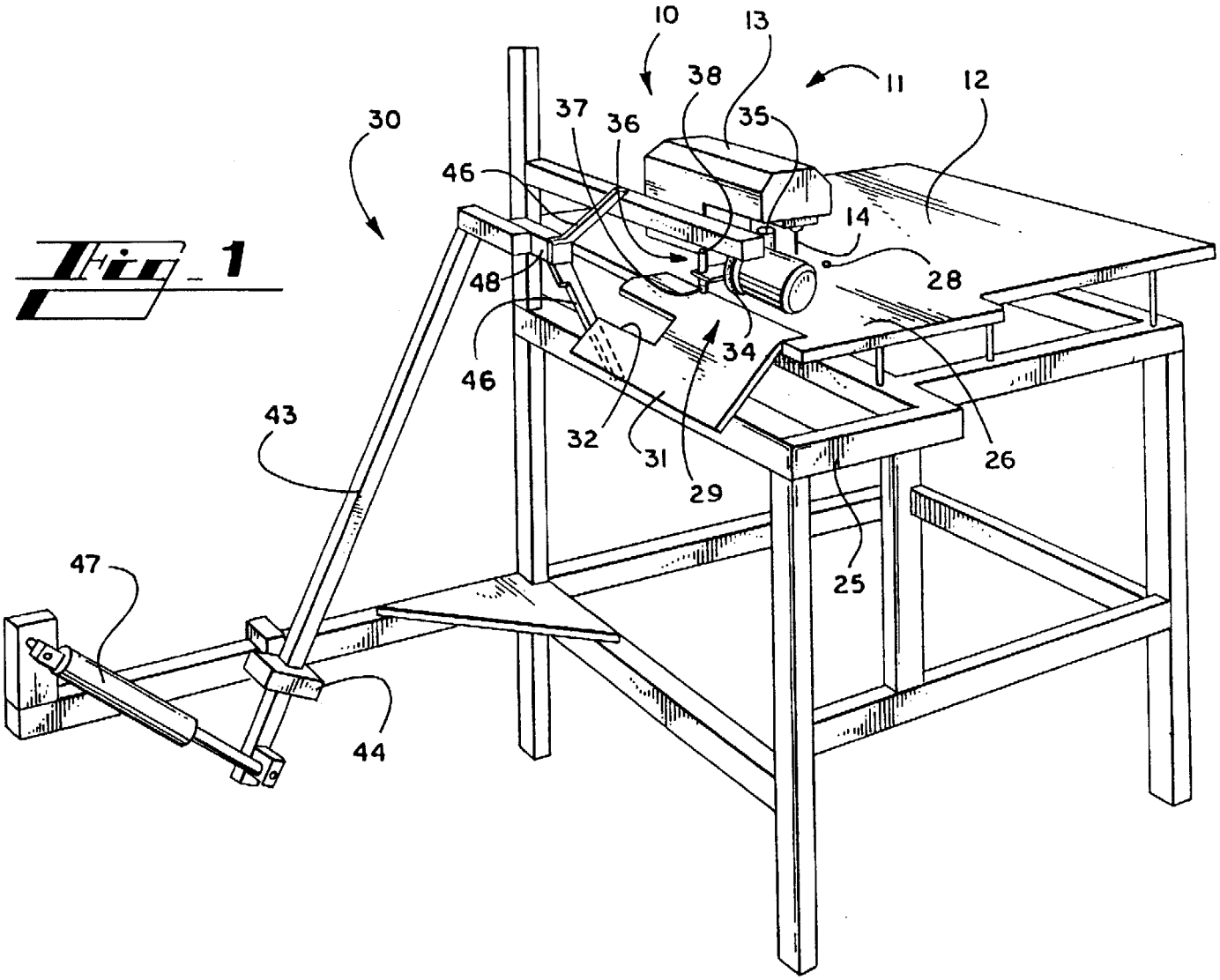
FIG. 1 is a perspective view of a stacker embodying principles of the invention in a preferred form shown coupled to a sewing machine.

Referring next to the drawings, there is shown a stacker 10 embodying principles of the invention in a preferred form. The stacker 10 is shown coupled to a conventional sewing machine 11 of the type having a sewing bed 12 and a sewing head 13 with a sewing needle 14. The sewing machine may have a sewing head such as that made by Pegasus Sewing Machine Company, Ltd. of Osaka, Japan as model number S-52, and a drive motor such as that made by Comelz Italia of Vigavano, Italy as model Argo 42AM/AD3. The drive motor has a multiprocessor which will be used in controlling the actuation of the stacker as described in more detail hereinafter. The sewing machine 11 and stacker 10 are designed to manipulate a sheet of material 17 having a leading edge 18 defining a leading portion 19 and a trailing edge 21 defining a trailing portion 22, each being with respect to the direction of material travel as it is sewn. The stacker has a support frame 25, a support bed 26 supported upon the frame 25 which extends from the sewing bed 12, a first photoelectric eye 28, a wheel assembly 29 mounted to the frame, and a grasping assembly 30 mounted to the frame. The support bed 26 has a downturned rear guide plate 31 with an elongated slot 32 therethrough. The first photoelectric eye 28 is mounted to the sewing bed 12 closely adjacent the sewing needle 14 to sense the presence of the material trailing edge 21 adjacent the sewing needle 14.

Figure 3:
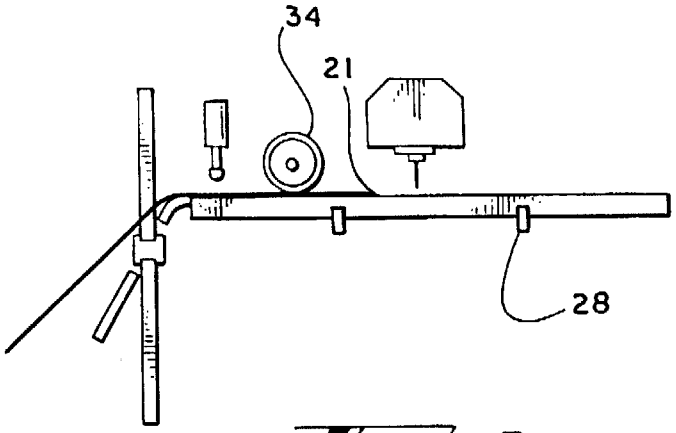
FIG. 2–8 are a sequence of schematic views of a portion of the stacker of FIG. 1 shown coupled with a sewing machine, which show, in sequence, a sheet of material being stacked.
Figure 2:
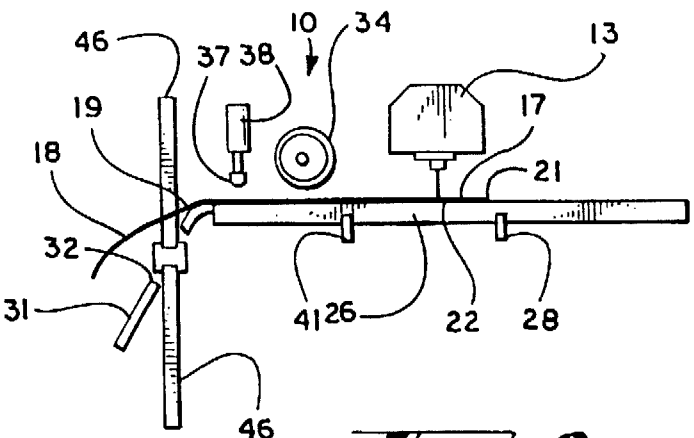
Figure 4:
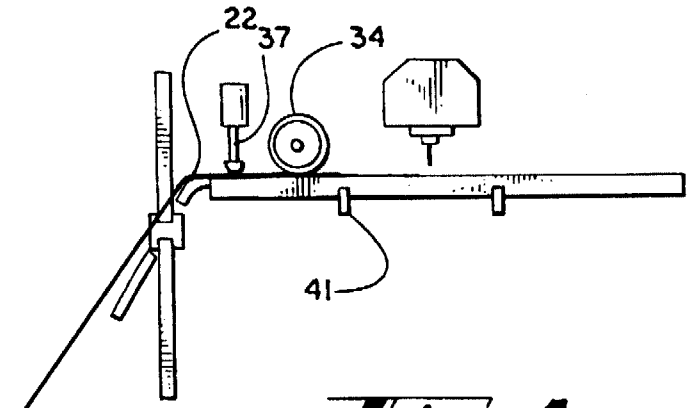

The wheel assembly 29 has a motorized wheel 34 coupled to a pneumatic cylinder 35 for movement between a lowered, active position closely adjacent the support bed and in contact with the material thereon, as shown in FIG. 3, and an elevated, static position distal the support bed, as shown in FIG. 2. The wheel assembly 29 also includes a separate material holder 36 having a holding finger 37 coupled to a pneumatic cylinder 38 for movement between a lowered, engaged position contacting the material upon the support bed, as shown in FIG. 4, and an elevated, disengaged position distal the support bed 12, as shown in FIG. 2. A second photoelectric eye 41 is mounted adjacent the motorized wheel 34 to sense the passing thereby of the material trailing edge 21.

Figure 5:
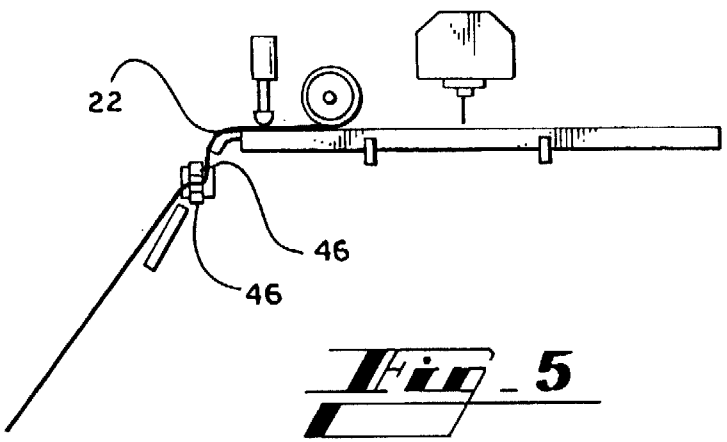
Figure 8:
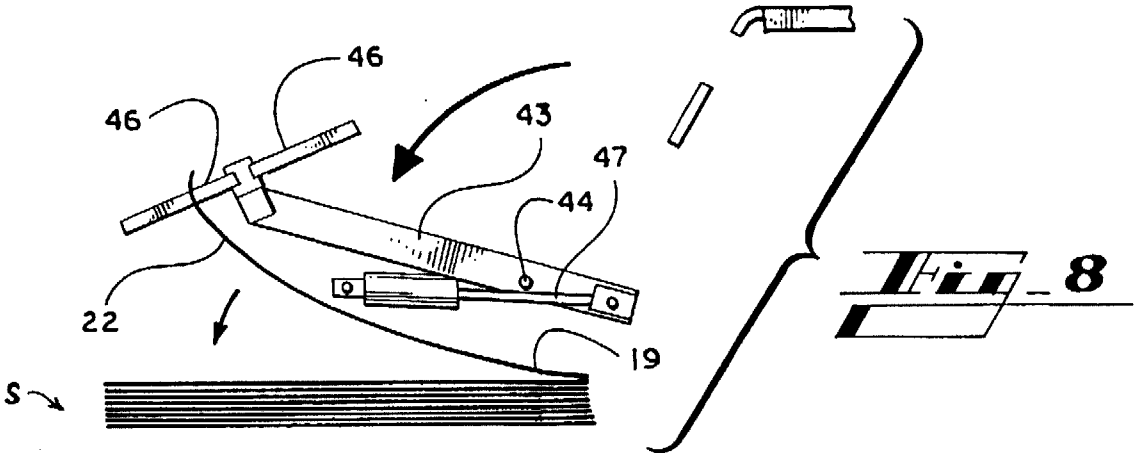
Figure 6:
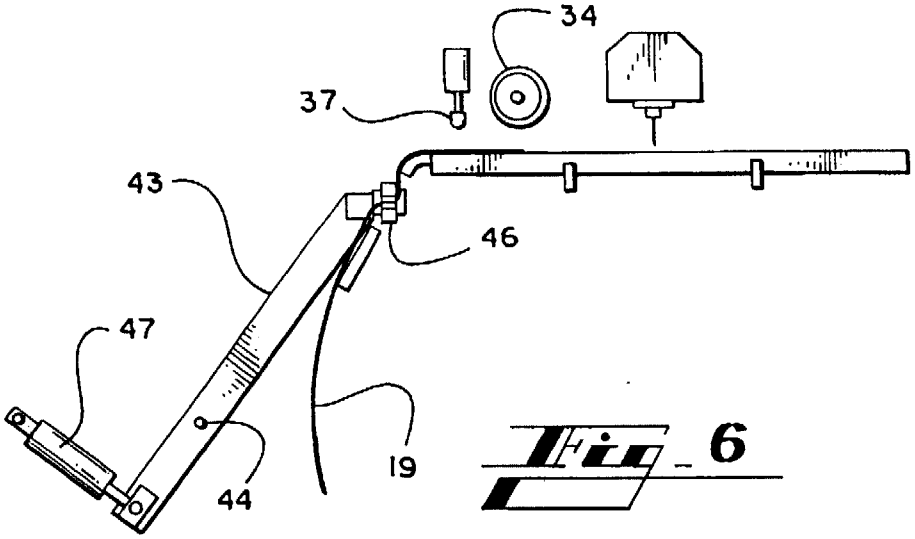

The grasping assembly 30 includes an elongated arm 43 pivotably mounted to the frame 25 for movement about a pivot 44. The elongated arm 43 has a pair of pivotably grasping fingers 46 mounted at one end and a pneumatic cylinder 47 mounted at an opposite end. The grasping fingers 46 are actuated by a pneumatic cylinder 48 for movement between a grasping or pinching configuration closely adjacent each other, as best shown in FIG. 5, and a release configuration separated from each other, as best shown in FIG. 2. Pneumatic cylinder 47 is mounted to the arm 43 below pivot 44 for reciprocal, pivotable movement of the arm between a grasping position with the grasping fingers adjacent the support bed, as shown in FIG. 2, and a stacking position adjacent a stacking station S, as shown in FIG. 8.

Each of the aforementioned pneumatic cylinders includes a control valve for the actuation thereof. The multiprocessor of the sewing machine drive motor is coupled to the motorized wheel 34 for the selective energization thereof, and the first and second photoelectric eyes 28 and 41. The multiprocessor is also coupled to the control valves of the grasping finger pneumatic cylinder 48, the arm pneumatic cylinder 47, the motorized wheel pneumatic cylinder 35, and holding finger pneumatic cylinder 38. All electrical wiring and pneumatic lines have been eliminated for clarity of illustration.

In use, initially the multiprocessor inactivates the motorized wheel 34 and signals the pneumatic cylinders so as to position the arm 43 to its grasping position, the grasping fingers 46 to their release configuration, the motorized wheel 34 to its static position, and the holding finger 37 to its disengaged position. A sheet of material 17 is then positioned by an operator adjacent the sewing head 13 and stitched by the sewing machine needle 14 while simultaneously being advanced forward by the sewing head 13.

As the material trailing edge 21 passes the first photoelectric eye 28 a signal is sent to the multiprocessor which in turn signals the sewing head to complete the stitching process and signals the pneumatic cylinder 35 to move the motorized wheel 34 to its active position in contact with the material 17. The multiprocessor then energizes the motorized wheel 34 to cause the continuous forward movement of the material. The material is advanced over the guide plate 31 to a position wherein the leading portion 19 of the material gravitationally depend therefrom, as shown in FIG. 3. As the material trailing edge 21 approaches the motorized wheel it passes the second photoelectric eye 41 which signals the multiprocessor to de-energize the motorized wheel and signals the pneumatic cylinder 38 so as to move holding finger 37 to its engaged position in contact with the material, as shown in FIG. 4. As such, the motorized wheel 34 and holding finger 37 hold the trailing portion 22 of the material against the support bed 26 while the majority of the material depends therefrom. The multiprocessor then signals pneumatic cylinder 48 to move the grasping fingers 46 to their pinching configuration grasping the trailing portion 22 of the material therebetween, as shown in FIG. 5. The lower grasping finger passes through the slot 32 of the guide plate 31 into contact with the bottom surface of the material.

Figure 7:
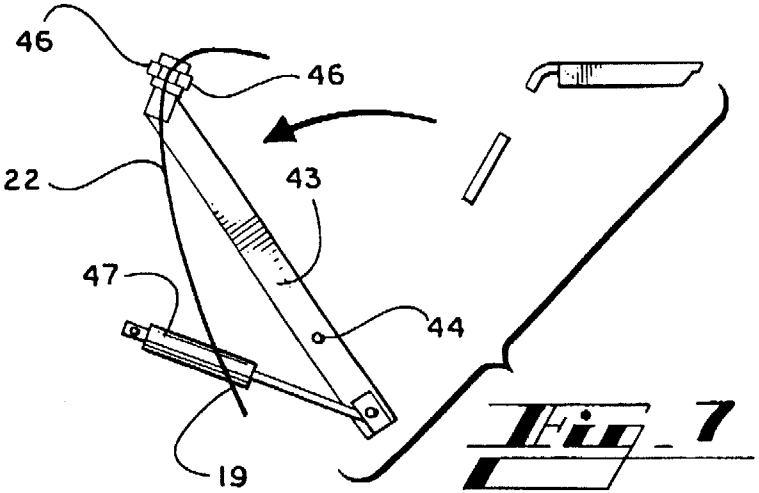

Once the material has been grasped, the multiprocessor then actuates pneumatic cylinders 35 and 38 so as to move the motorized wheel 34 to its elevated position and to move the holding finger 37 to its disengaged position. Pneumatic cylinder 47 is then actuated to pivot the arm from its grasping position to its stacking position, as shown in FIGS. 7 and 8. The pivotal movement of the arm brings the trailing portion of the material over the leading portion of the material thereby inverting the material. As the arm approaches the stacking position the grasping fingers are once again spread apart to their release configuration thereby releasing the material. The material sequentially falls onto a support surface or upon previously stacked material and the components of the stacker are returned to their initial positions.

The just describe apparatus has been designed to stack material in a very fast and efficient manner. This is accomplished by allowing the material to depend from the support surface prior to mechanical movement thereof and then flipping the trailing edge over the leading edge along approximately a 90 degree arc. This is done without regard to the length of the material. As such, the material is mechanically moved for stacking along a distance generally much less than the length of the material itself. This eliminates the problem of moving the material along a distance equal to or greater than its length, a problem which has heretofore limited the efficiency of known stackers. Also, it is believed that the mounting of pneumatic cylinder 47 below pivot 44 provides the optimal arm pivot speed and torque required to move the material in the just described fashion.

It should be understood that hydraulic cylinders, solenoids, electric motors or other types of actuation means may be used in place of the just described pneumatic cylinders. It should also be understood that material holder 36 may be eliminated as the motorized wheel itself holds the material in place during its grasping. However, the preferred embodiment includes the material holder to ensure that the material does not slip. Also, the photoelectric eyes may be positioned above the support surface rather than within the bed and the exact position of the photoelectric eyes may vary depending upon sewing variables such as the type of sewing machine used, its sewing speed and the type of stitching produced therefrom.

Thus, an improved stacker is now provided which quickly and efficiently stacks material. While this invention has been described in detail with particular references to preferred embodiments thereof, it should be understood that many modifications, additions and deletions may be made thereto without departure from the spirit and scope of the invention as set forth in the following claims.

We claim:

1. A stacking device for use with a sewing machine having a sewing head for stitching a sheet of material having a leading portion adjacent a leading edge and a trailing portion adjacent a trailing edge each with respect to the direction of movement as the material is stitched by the sewing machine, said stacking device comprising, in combination:

support means adjacent the sewing head for supporting a trailing portion of a sheet of material thereon, said support means being configured to allow a leading portion of the material to depend therefrom;

holding means for releasably holding the trailing portion of the material with the leading portion depending from said support means;

grasping means for grasping the material adjacent the material trailing edge;

pivot means for reciprocally moving said grasping means between a grasping position adjacent said support means and a stacking position distal said support means; and control means for controlling the actuation of said holding means, said grasping means and said pivot means;

whereby upon completion of the stitching of the material the material is positioned with the material leading portion depending from the support means and the holding means holding the material trailing portion, the grasping means is actuated to grasp the material trailing portion, and the pivot means moves the grasping means to the stacking position whereupon the grasping means are actuated to release the material.

2. The stacking device of claim 1 wherein said holding means also includes advancement means for advancing the material in the direction of material movement.

3. The stacking device of claim 2 wherein said advancement means comprises a motorized wheel.

4. The stacking device of claim 3 wherein said motorized wheel is movable between an engaged position elevated above said support means and the material and an engaged position contacting the material upon the support means.

5. The stacking device of claim 4 wherein said holding means further comprises a holding finger movable between a disengaged position elevated above said support means and the material and an engaged position contacting the material.

6. The stacking device of claim 1 wherein said holding means comprises a holding finger movable between a disengaged position elevated above said support means and the material and an engaged position contacting the material.

7. The stacking device of claim 1 wherein said grasping means comprises two grasping fingers moveable between an open position distal each other and a closed position adjacent each other gripping the material therebetween.

8. The stacking device of claim 1 wherein said pivot means comprises a pivot arm coupled at one end to said grasping means and having a pivot point adjacent an opposite end, and actuation means for reciprocal movement of said pivot arm about said pivot point between a first position with said grasping means adjacent said support means a second position with said grasping means distal said support means.

9. The stacking device of claim 8 wherein said actuation means comprises movement means coupled to said pivot arm at a selected location adjacent said opposite end for movement of said pivot arm and with said pivot point position between said grasping means and said selected location.

10. The stacking device of claim 4 further comprising sensing means coupled to said control means for sensing the passing of the material adjacent the sewing head.

11. The stacking device of claim 10 wherein said sensing means comprises a photoelectric eye.

12. The stacking device of claim 10 further comprising second sensing means coupled to said control means for sensing the passing of the material trailing edge adjacent said advancement means.

13. A method of stacking a sheet of material having a top surface, a bottom surface, and a leading portion and a trailing portion with respect to the orientation and direction of material movement as it is sewn, the method comprising the steps of:

(a) advancing the material with the top surface facing upwards over the upper surface of a support surface to a position wherein the material leading portion extends beyond an edge of the support surface so as to gravitationally depend therefrom;

(b) holding the material trailing portion;

(c) grasping the material trailing portion with grasping means;

(d) moving the grasping means so as to move the trailing portion along an arc generally above the material leading portion depending from the support surface so as to invert the material with the bottom surface facing upwards; and (e) releasing the material trailing portion.

14. The method of claim 13 wherein step (a) the material is advanced with a motorized wheel.

15. The method of claim 14 wherein step (a) the material is advanced with a motorized wheel which is movable between a disengaged position elevated above the support surface and the material and an engaged position in contact with the material.

16. The method of claim 15 wherein the material is held with a holding finger movable between a disengaged position elevated above the support surface and the material and an engaged position contacting the material.

17. The method of claim 13 wherein the material is held with a holding finger movable between a disengaged position elevated above the support surface and the material and an engaged position contacting the material.

18. The method of claim 13 wherein the material is grasped with two pivotable fingers movable between an open configuration distal each other and a closed configuration adjacent each other gripping the material therebetween.

19. The method of claim 13 wherein the material is moved with pivot means having a pivot arm coupled at one end to said grasping means and having a pivot point adjacent an opposite end, and actuation means for reciprocal movement of the pivot arm about the pivot point between a first position with the grasping means adjacent the support surface and a second position with the grasping means distal the support surface.

20. The method of claim 19 wherein the actuation means has movement means coupled to the pivot arm at a selected location adjacent the opposite end and with the pivot point positioned between the grasping means and the opposite end.

21. The method of claim 15 further comprising the step of sensing the passing of the material trailing edge adjacent the sewing head and wherein the advancing of the material is in response to the sensing of the material trailing edge adjacent the sewing head.

22. The method of claim 21 further comprising the step of sensing the position of the material trailing edge adjacent the wheel and wherein the grasping of the material is in response to the sensing of the material trailing edge adjacent the wheel.

* * * * *